US009910405B2

(12) United States Patent
Watanabe et al.

(10) Patent No.: US 9,910,405 B2
(45) Date of Patent: Mar. 6, 2018

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Takanori Watanabe, Kawasaki (JP); Akihisa Matsukawa, Fuchu (JP); Kuniaki Tamagaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/257,678

(22) Filed: Sep. 6, 2016

(65) Prior Publication Data

US 2017/0068211 A1 Mar. 9, 2017

(30) Foreign Application Priority Data

Sep. 9, 2015 (JP) ..... 2015-177907

(51) Int. Cl.
*G03G 21/16* (2006.01)
*G03G 21/18* (2006.01)
*G03G 15/08* (2006.01)

(52) U.S. Cl.
CPC ..... *G03G 21/1817* (2013.01); *G03G 15/081* (2013.01); *G03G 21/181* (2013.01)

(58) Field of Classification Search
CPC . G03G 15/081; G03G 21/181; G03G 21/1817
See application file for complete search history.

(56) References Cited

U.S. PATENT DOCUMENTS 9,098,009 B2 * 8/2015 Tosuji ..... G03G 15/081

FOREIGN PATENT DOCUMENTS

JP 3093918 B2 10/2000
JP 2013222147 A 10/2013

* cited by examiner

*Primary Examiner* — Hoang Ngo
(74) *Attorney, Agent, or Firm* — Canon U.S.A., Inc. IP Division

(57) ABSTRACT

A developing device includes a developer bearing member, a regulating member configured to regulate an amount of the developer borne by the developer bearing member, and a toner seal member being in contact with a peripheral surface of the developer bearing member. The regulating member includes a flexible support member and a blade member supported by the support member and being in contact with the developer bearing member, an end portion of the regulating member more protrudes toward the developer bearing member than a central portion thereof in a rotation axial direction of the developer bearing member. The toner seal member is pressed along the rotation axial direction to the end portion of the regulating member in the rotation axial direction.

14 Claims, 5 Drawing Sheets

DEVELOPING DEVICE, PROCESS CARTRIDGE, AND IMAGE FORMING APPARATUS

BACKGROUND OF THE INVENTION

Field of the Invention

The present invention relates to a developing device in a copier, laser beam printer, facsimile, or another equipment using an electrophotographic system and to a process cartridge and image forming apparatus.

Description of the Related Art

An image forming apparatus using an electrophotographic system, such as a copier, visualizes an electrostatic latent image formed on an image bearing member, such as a photosensitive drum, as a toner image at a developing device and then transfers it to a recording medium at a transfer nip portion defined by the photosensitive drum and a transfer roller. After that, the image forming apparatus fixes the toner image on the recording medium at a nip portion in a fixing device. In this way, the image forming apparatus forms the image on the recording medium.

The developing device has a configuration that includes a toner container for accommodating toner (developer), a developing sleeve (developer bearing member) for bearing and conveying the toner, and a regulating blade for making the toner layer on the developing sleeve uniform and controlling a frictional charge of the toner. As the regulating blade, a configuration in which a flexible metallic support member is covered with a blade member made of a rubber elastic material, such as urethane rubber or polyamide resin is used (Japanese Patent Laid-Open No. 2013-222147). With that configuration, endurance of the regulating blade can be improved, and the regulating blade can be made to be in contact with the developing sleeve with a stable contact pressure and charges can be easily supplied from the regulating blade to the toner.

The developing device is equipped with a toner seal member being in contact with the developing sleeve and regulating blade and configured to seal the toner in a longitudinal end portion. Traditionally, the longitudinal end portion of the regulating blade is arranged on the toner seal member, and the regulating blade is pressed to the developing sleeve by the toner seal to prevent the toner from leaking from a gap between the regulating toner and developing sleeve in the longitudinal end portion. However, in that configuration, because the regulating blade is pressed to the developing sleeve by the toner seal, the thickness of the toner layer on the developing sleeve is not uniform. This may lead to unstable image quality, and may cause the developing sleeve to be shaved by the regulating blade.

Another configuration in which a longitudinal end surface of the regulating blade is pressed by the toner seal member is conceived (Japanese Patent No. 3093918). With that configuration, a rise in the contact pressure between the regulating blade and development roller in the vicinity of the toner seal member can be reduced, and the contact pressure of the regulating blade with respect to the development roller in the longitudinal direction can be made uniform. Consequently, the stabilization of image quality and the prevention of shaving of the developing sleeve can be compatible with the prevention of toner leakage.

SUMMARY OF THE INVENTION

However, in the case of the configuration in which the toner seal member is pressed to the longitudinal end surface of the regulating blade, the performance of sealing the toner may be insufficient depending on the state of the end portion crone blade member to which the toner seal member is pressed. In particular, when a regulating blade including a flexible support member covered with an elastic blade member is used, as a result of causing the toner seal member to be in contact with the longitudinal end surface of the regulating blade, the longitudinal end surface of the regulating blade may be more deformed in a direction distant from the developing sleeve than the longitudinal central portion thereof. That deformation may generate a gap between the regulating blade and toner seal member and lead to toner leakage, may weaken the regulating force of the regulating blade in the vicinity of the toner seal, or may cause a failure in regulating the toner. If the failure in regulating the toner occurs, the amount of toner coating in the longitudinal end portion of the development roller increases, toner scattering occurs, and a defect, such as so-called fogging phenomenon in which toner is attached to other than an electrostatic latent image portion, appears.

The present invention provides a developing device including a developer bearing member configured to bear a developer, a regulating member configured to regulate an amount of the developer borne by the developer bearing member, and a toner seal member being in contact with a peripheral surface of the developer bearing member. The regulating member includes a flexible support member and a blade member supported by the support member and being in contact with the developer bearing member, an end portion of the regulating member more protrudes toward the developer bearing member than a central portion thereof in a rotation axial direction of the developer bearing member. The toner seal member is pressed from the rotation axial direction to the end portion of the regulating member in the rotation axial direction.

The present invention provides a method for manufacturing a developing device including a developer bearing member configured to bear a developer, a regulating member configured to regulate an amount of the developer borne by the developer bearing member, and a toner seal member being in contact with a peripheral surface of the developer bearing member. The method includes forming the regulating member by integrally forming a flexible plate member that is to be a support member and a resin portion that is to be a blade member such that an end portion thereof more protrudes than a central portion thereof in a rotation axial direction of the developer bearing member, arranging the regulating member such that the end portion protrudes toward the developer bearing member, and mounting the toner seal member by pressing the toner seal member from the rotation axial direction to the end portion of the regulating member in the rotation axial direction.

The present invention provides a process cartridge including an image bearing member, a developer bearing member configured to bear a developer and develop the image bearing member, a regulating member configured to regulate an amount of the developer borne by the developer bearing member, and a toner seal member being in contact with a peripheral surface of the developer bearing member. The regulating member includes a flexible support member and a blade member supported by the support member and being in contact with the developer bearing member, an end portion of the regulating member more protrudes toward the developer bearing member than a central portion thereof in a rotation axial direction of the developer bearing member.

The present invention provides a method for manufacturing a process cartridge including an image bearing member, a developer bearing member configured to bear a developer and develop the image bearing member, a regulating member configured to regulate an amount of the developer borne by the developer bearing member, and a toner seal member being in contact with a peripheral surface of the developer bearing member. The method includes forming the regulating member by integrally forming a flexible plate member that is to be a support member and a resin portion that is to be a blade member such that an end portion thereof more protrudes than a central portion thereof in a rotation axial direction of the developer bearing member, arranging the regulating member such that the end portion protrudes toward the developer bearing member, and mounting the toner seal member by pressing the toner seal member from the rotation axial direction to the end portion of the regulating member in the rotation axial direction.

The present invention provides an image forming apparatus including a detachable process cartridge. The process cartridge includes an image bearing member, a developer bearing member configured to bear a developer and develop the image bearing member, a regulating member configured to regulate an amount of the developer borne by the developer bearing member, and a toner seal member being in contact with a peripheral surface of the developer bearing member. The regulating member includes a flexible support member and a blade member supported by the support member and being in contact with the developer bearing member, an end portion of the regulating member more protrudes toward the developer bearing member than a central portion thereof in a rotation axial direction of the developer bearing member. The toner seal member is pressed from the rotation axial direction to the end portion of the regulating member in the rotation axial direction.

Further features of the present invention will become apparent from the following description of exemplary embodiments with reference to the attached drawings.

DESCRIPTION OF THE EMBODIMENTS

Mode for carrying out the present invention is illustratively described in detail below on the basis of an embodiment with reference to the drawings. The dimensions, materials, shapes, and relative arrangement of the components described in the mode should be changed depending on the configuration or conditions to which the invention is applied. That is, the scope of the present invention is not intended to be limited to the mode described below.

[1. Image Forming Apparatus]

Figure 1:
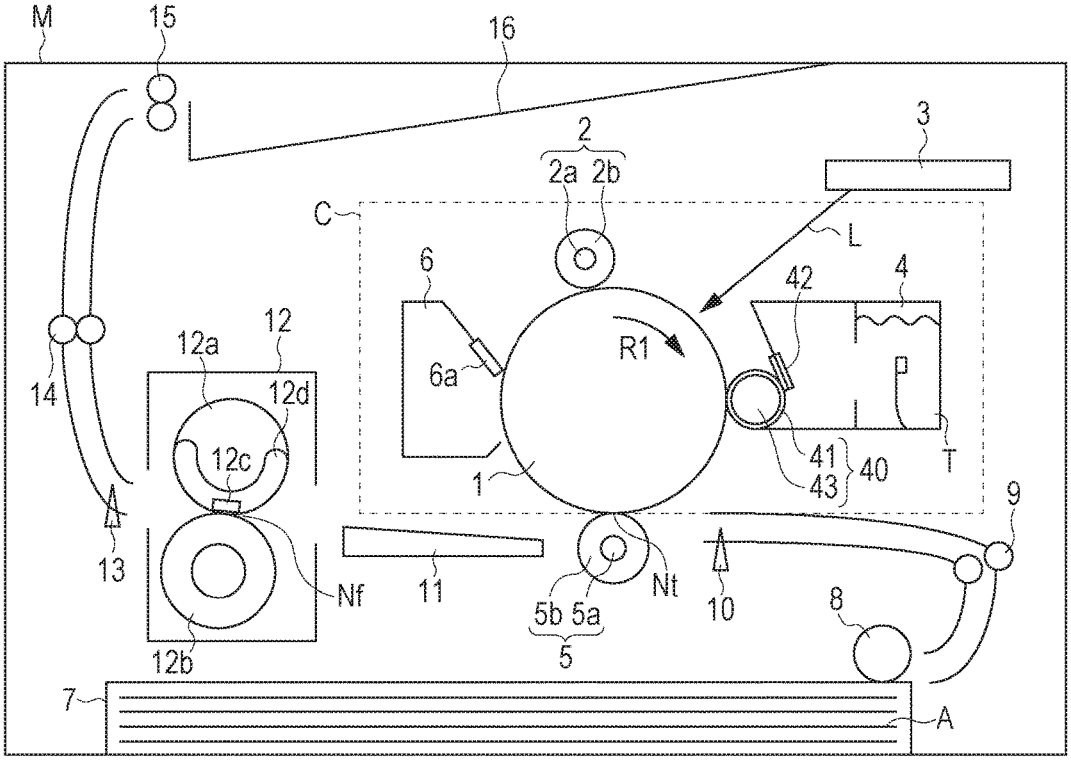
FIG. 1 is a cross-sectional view that illustrates a configuration of an image forming apparatus according to an embodiment.

FIG. 1 illustrates an image forming apparatus M according to the present invention. A configuration of the image forming apparatus N is described below with reference to FIG. 1. FIG. 1 is a longitudinal sectional view that illustrates a schematic configuration of a laser beam printer as one example of the image forming apparatus N according to the present invention. The image forming apparatus N is configured such that a process cartridge C as an image forming unit is detachable from a main body of the image forming apparatus. The process cartridge C includes a photosensitive drum 1 (photosensitive member), a charging roller 2 (charging member), a developing device 4, and a cleaning device 6 (toner removing unit).

The photosensitive drum 1 includes a cylindrical or columnar base, a charge generation layer, and a charge transport layer. The charge generation layer and charge transport layer are laminated on an endless peripheral surface of the base in sequence from the base side. The base may be made of an aluminum cylinder. A high-sensitivity phthalocyanine compound may be used in the charge generation layer. Examples of the phthalocyanine compound may include copper phthalocyanine, oxy-titanium phthalocyanine, silicon phthalocyanine, and gallium phthalocyanine. In the present embodiment, gallium phthalocyanine is used. The charge transport layer is disposed on the charge generation layer. Examples of a material that can be used in the charge transport layer may include polymethyl methacrylate, polystyrene, styrene-acrylonitrile copolymer, polycarbonate resin, diallyl phthalate resin, polyarylate resin. In the present embodiment, polycarbonate resin is used. The charge generation layer and charge transport layer can be formed by thin film coating performed on the base.

The charging roller 2 uniformly charges the surface of the photosensitive drum 1 with a predetermined potential. The charging roller 2 includes a metal core 2*a* and a conductive elastic layer 2*b* integrally formed with the metal core 2*a*. The opposite end portions of the metal core 2*a* in the charging roller 2 are supported by bearings such that the charging roller 2 is rotatable, and the charging roller 2 is arranged in substantially parallel with the photosensitive drum 1. The charging roller 2 is pressed in contact with a developing sleeve 41 with a predetermined pressing force against the elasticity of the conductive elastic layer 2*b* and is thus rotated by following rotation of the photosensitive drum 1.

The developing device 4 develops an electrostatic latent image formed on the photosensitive drum 1. The developing device 4 includes a development roller 40 (developer bearing member) configured to bear and convey toner T in the developing device 4 and a regulating blade 42 (regulating member) configured to make a toner layer on the developing sleeve 41 uniform. In the present embodiment, an element including the developing sleeve 41 having a cylindrical shape and a magnet 43 arranged inside the developing sleeve 41 is used as the development roller 40. The details of the configuration of the developing device 4 will be described below.

The cleaning device 6 cleans the surface of the photosensitive drum 1 after an image is transferred therefrom. The cleaning device 6 includes a cleaning blade 6*a* in which a metal sheet is provided with an elastic member. The cleaning device 6 is in contact with the photosensitive drum 1 between a transfer position where a toner image is transferred from the photosensitive drum 1 to a recording medium A, such as paper, and a charge position where the photosensitive drum 1 is in contact with the charging roller 2. In the cleaning device 6, the elastic member is arranged such that the leading edge portion of the elastic member can be in contact with the surface of the photosensitive drum 1 with a predetermined pressing force in a so-called counter-direction. One example of the material of the elastic member may be polyurethane rubber in terms of wear resistance, permanent deformation, and the like.

Next, the main body of the image forming apparatus is described.

The image forming apparatus M includes a laser exposure unit 3 (exposing unit), a fixing device 12 (fixing unit), and a sheet feeding unit. The present embodiment illustrates an example of a configuration in which the image forming apparatus M further includes a transfer roller 5 (contact transfer unit). Another configuration that does not include the transfer roller 5 may also be used.

The laser exposure unit 3 exposes the photosensitive drum 1 by using a laser beam L in accordance with an image to be formed. The laser exposure unit 3 includes a laser output portion configured to output a laser beam corresponding a digital pixel signal, a rotating polygon mirror (polygon mirror), an fθ lens, and a reflector.

The transfer roller 5 causes a recording medium A to come into contact with the photosensitive drum 1 with a predetermined pressure and transfers toner to the recording medium A. The transfer roller 5 includes a metal core 5*a* and a medium-resistance foam layer 5*b* with a roller resistance value on the order of $5\times10^8\Omega$. The transfer roller 5 used in the present embodiment is in pressure contact with the photosensitive drum 1 in a predetermined manner, forms a transfer nip portion Nt, applies a transfer bias opposite in polarity to toner to the metal core 5*a*, and performs transferring.

The fixing device 12 fixes the toner transferred to the recording medium A and unites them. The fixing device 12 includes a fixing film 12*a*, a pressure roller 12*b* (pressure member), a ceramic heater 12*c*, and a heater holder 12*d* (heater support member).

The fixing film 12*a* is a flexible endless belt and is made of a heat-resistant resin, such as polyimide. The pressure roller 12*b* is in contact with the fixing film 12*a* and forms a fixing nip portion Nf. Thus, the fixing film 12*a* is configured to be rotated by following the pressure roller 12*b* being driven (pressure roller driving method). The ceramic heater 12*c* can heat toner through the pressure roller 12*b* and fixing film 12*a*. The heater holder 12*d* is configured to support the ceramic heater 12*c*.

The sheet feeding unit includes a cassette 7, a sheet feeding roller 8, and sheet feeding rollers 9. The cassette 7 contains recording media A. The sheet feeding roller 8 supplies the recording media A one by one from the cassette 7. The sheet feeding rollers 9 convey the recording medium A supplied from the sheet feeding roller 8. In addition, in sequence along a conveyance path for the recording media A, a leading-end position detecting sensor 10, a conveyance guide 11, a sheet discharge sensor 13, conveyance rollers 14, discharge rollers 15, and an output tray 16 are arranged.

[2. Image Forming Operation]

Next, image forming operation in the image forming apparatus having the above-described configuration is described.

The photosensitive drum 1 rotated in a direction indicated by an arrow R1 in FIG. 1 by a driving source (not illustrated) is charged to a predetermined potential Vd by the charging roller 2. After the surface of the charged photosensitive drum 1 reaches an exposure position, a laser element in the laser exposure unit 3 is lit in accordance with image information, and an electrostatic latent image is formed. The surface potential of the photosensitive drum subjected to the exposure falls to an exposure portion potential V1. The electrostatic latent image formed on the surface of the photosensitive drum 1 is developed and visualized with toner on the developing sleeve 41 by a potential difference between a direct current voltage Vdc applied to the developing sleeve 41 (development bias) and the exposure portion potential V1 (hereinafter referred to as development contrast). The visualized toner image is transferred to the recording medium A at the transfer nip portion Nt by the transfer roller 5. The recording media A are fed one by one from the sheet supplying cassette 7 by the sheet feeding roller 8 and conveyed by the sheet feeding rollers 9 to the transfer nip portion Nt, which is positioned between the photosensitive drum 1 and transfer roller 5. At that time, the leading end of the recording medium A is detected by the leading-end position detecting sensor 10 and is thus synchronized with the toner image on the photosensitive drum 1. A transfer voltage opposite in polarity to the charging polarity of the toner is applied to the transfer roller 5, and this causes the toner image on the photosensitive drum 1 to be transferred to a predetermined position on the recording medium A.

The recording medium A bearing the unfixed toner image on its surface obtained by transferring is conveyed along the conveyance guide 11 to the fixing device 12, the unfixed toner image is heated and pressed at the fixing nip portion Nf, and it is fixed on the surface of the recording medium A. The recording medium A having passed through the fixing nip portion Nf is curvature-separated from the fixing film 12*a*.

The recording medium A with the fixed toner image is conveyed by the conveyance rollers 14 and discharged onto the output tray 16, which is arranged on the upper surface of the main body of the apparatus, by the discharge rollers 15.

As for the photosensitive drum 1 from which the toner image has been transferred, toner that is not transferred to the recording medium A and remains on the surface of the photosensitive drum 1 (transfer-residual toner) is removed and collected by the cleaning blade 6*a* in the cleaning device 6, and it is supplied to next image formation.

By repeating the above-described operation, images can be sequentially formed.

[3. Developing Device]

Figure 2:
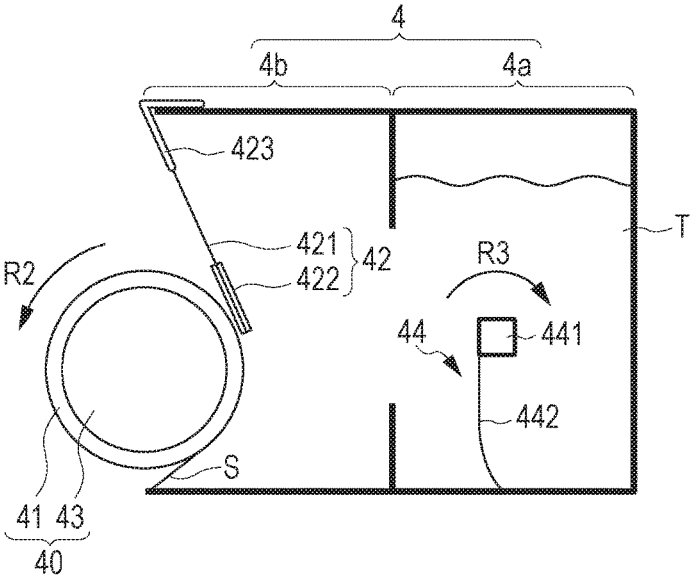
FIG. 2 is a cross-sectional view that illustrates a configuration of a developing device according to the embodiment.

FIG. 2 is a cross-sectional view of the developing device 4 according to the present embodiment. The developing device according to the present invention is described with reference to FIG. 2.

As illustrated in FIG. 2, the developing device 4 includes a toner storage chamber 4*a* that stores toner therein and a developing chamber 4*b* including the development roller 40 and regulating blade 42.

The development roller 40 includes the developing sleeve 41 forming the peripheral surface and having a cylindrical shape and the magnet 43 arranged inside the developing sleeve 41. The developing sleeve 41 includes a support portion made of an aluminum or stainless steel pipe as a nonmagnetic sleeve and a conductive elastic layer laminated on the peripheral surface of the support portion. The developing sleeve 41 is supported so as to be rotatable in a direction indicated, by an arrow R2 with respect to the developing chamber 4*b*. The developing sleeve 41 has an external diameter of ϕ 11 mm and typically has an average surface roughness Ra of 1.5 mm to 4.5 mm in the Japanese Industrial Standards. Because the surface of the developing sleeve 41 has such an appropriate surface roughness, it can bear and convey a predetermined amount of toner. The developing sleeve 41 is pressed toward the photosensitive drum 1 such that it is in contact with the photosensitive drum 1. An inroad amount regulating roller (not illustrated) is arranged on each of the opposite end portions of the developing sleeve 41 in its longitudinal direction (rotation axial direction), and these regulating rollers are in contact with the photosensitive drum 1 such that the inroad amount between the developing sleeve 41 and the surface of the photosensitive drum 1 can be kept at a predetermined value.

A developing sleeve gear is fixed on one end portion of the developing sleeve 41, a driving force is transmitted to the developing sleeve gear from the driving source in the main body of the image forming apparatus through a plurality of gears, and thus the developing sleeve 41 is rotated. The surface of the developing sleeve 41 is rotated in a forward direction faster than the surface of the photosensitive drum 1 with a velocity ratio of 140% to the peripheral speed of the surface of the photosensitive drum 1.

The magnet 43 is arranged inside the developing sleeve 41. As the magnet 43, a cylindrical quadruple magnet roll in which the north poles and south poles are alternately arranged in its peripheral direction is used. The four poles are not illustrated and consist of a development pole 43*a* opposing the photosensitive drum 1, a regulation pole 43*b* opposing the regulating blade 42, a supply pole 43*c* for use in supplying toner in the developing chamber 4*b* to the developing sleeve 41, and a leakage prevention pole 43*d* in a portion opposite to a toner blowoff prevention sheet S. The magnetic flux density at the regulation pole is strongest and 70 mT, whereas the magnetic flux densities of the other poles are substantially the same and approximately 50 mT. Unlike the developing sleeve 41, which is rotated in the direction indicated by the arrow R2, the magnet 43 is fixed with respect to the developing chamber 4*b* inside the developing sleeve 41.

Figure 3A:
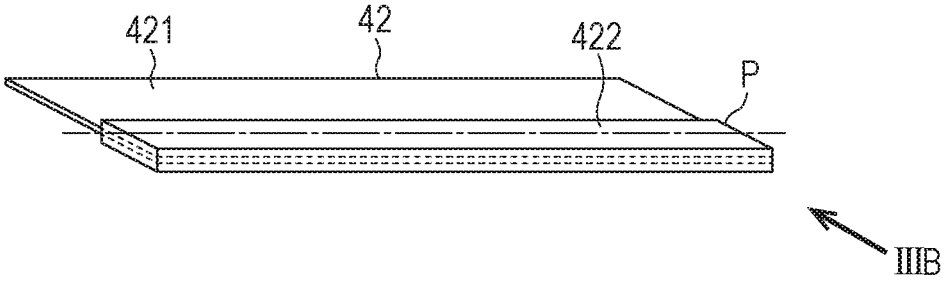
FIGS. 3A and 3B illustrate a configuration of a portion in the vicinity of a toner seal member according to the embodiment.

The regulating blade 42 regulates the layer thickness of toner attracted to the surface of the developing sleeve 41 by a magnetic force of the magnet 43. The configuration of the regulating blade 42 is described below. As illustrated in FIG. 3A, the regulating blade 42 is in contact with the developing sleeve 41 at a surface P in its longitudinal direction, which is the rotation axial direction of the developing sleeve 41. A free leading end portion in a blade member 422 is made to be in contact with the surface of the developing sleeve 41 by a predetermined pressure over the entire longitudinal area. The contact force is approximately 20 gf/cm to 60 gf/cm (contact load per centimeter in the longitudinal direction of the developing sleeve 41). An appropriate charge is provided to toner borne on the surface of the developing sleeve 41 by triboelectric charging produced by sliding and rubbing between the developing sleeve 41 and regulating blade 42 in regulating the layer thickness by the regulating blade 42, and then the toner is conveyed to a developing portion opposing the surface of the photosensitive drum 1. At that time, the developing sleeve 41 receives a development bias (Vdc) applied from a direct current power supply. The toner on the developing sleeve 41 is electrostatically attached to the electrostatic latent image formed on the surface of the photosensitive drum 1 in the developing portion by a potential V1 between the surface potential Vdc on the surface of the photosensitive drum 1 and potential V1 of the developing sleeve 41. In that way, the electrostatic latent image is developed as the toner image.

A toner conveyance member 44 is rotatably arranged inside the toner storage chamber 4*a* (inside the container), loosens toner inside the toner storage chamber 4*a*, and conveys the toner to the developing chamber 4*b*. As illustrated in FIG. 2, the toner conveyance member 44 includes shaft member 441 made of a resin material and a polyphenylene sulfide (PPS) film sheet 442. The toner conveyance member 44 rotates in a direction indicated by an arrow R3 in FIG. 2 by using its opposite ends in the longitudinal direction as its rotation center. In the present embodiment, a driving force for rotating the toner conveyance member 44 is used such that it corresponds to a proper rotation speed by passing through from the developing sleeve gear to a gear train.

In the present embodiment, a one-component magnetic toner with negative chargeability is used as the toner T. The toner T is the one in which 80 parts by weight of magnetic particles are present as a main component per 100 parts by weight of a binder resin (styrene/n-butyl acrylate copolymer), a wax or the like is contained, and 1.2 parts by weight of silica fine particles are used as an external additive.

[4. Regulating Blade]

Figure 3B:
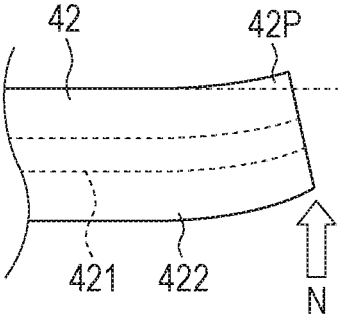

FIGS. 3A and 3B are schematic diagrams of the regulating blade 42 according to the present embodiment. FIG. 3A is an overall perspective view of the regulating blade 42. FIG. 3B is a schematic diagram of the longitudinal end portion before the regulating blade 42 is mounted, as seen from a leading end direction (direction IIIB in FIG. 3A).

As illustrated in FIG. 3B, the regulating blade 42 includes a blade member 422 having a shape in which its end portion in the longitudinal direction more protrudes in the thickness direction of the regulating blade 42 than the central portion. More specifically, the regulating blade 42 is used in which, at one end in the longitudinal direction, the end portion of the regulating blade 42 in the longitudinal direction bends, one side extending in a direction that crosses the longitudinal direction of the regulating blade 42 protrudes in the thickness direction of the regulating blade 42, and a side opposing that side protrudes toward the end portion in the longitudinal direction.

The regulating blade 42 includes a flexible support member 421 and the blade member 422. The blade member 422 is supported by and integral with a leading end portion of the support member 421 and is in contact with the developing sleeve 41. An example of the support member 421 may be a plate-like member that has a thickness on the order of 100 mm and that is made of stainless steel, phosphor bronze, or the like, and its base portion is fixed on a supporting plate 423 (FIG. 2). An example of the blade member 422 may be made of resin or elastomer. The regulating blade 42 has a shape in which the blade member 422, which covers and is integral with the leading end portion of the support member 421 and which is in contact with the developing sleeve 41, extends in the longitudinal direction.

Figure 4:
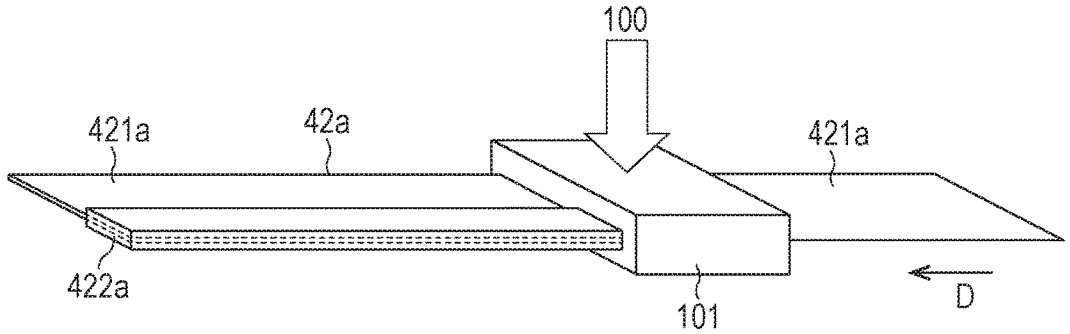
FIG. 4 is a schematic diagram that illustrates a shape of a longitudinal end portion of a regulating blade according to the embodiment.

The regulating blade 42 is produced in the way described below. First, a plate member 421*a* is prepared as a material of the support member 421. In the present embodiment, a stainless steel plate is used. The plate member 421*a* is inserted into a special mold 101 in an extrusion machine, as illustrated in FIG. 4 (in a direction indicated by an arrow D). While the plate member 421*a* is inserted into the extrusion machine, a resin that is a raw material for forming the blade member 422 is melted and continuously injected into a molding region in the special mold 101 by a blade member injection unit 100, and a component in which the plate member 421*a* and a resin portion 422*a* are integral with each other is formed. In the present embodiment, as the raw material of the blade member 422, polyimide elastomer of Shore D hardness 40° defined in JIS D6253 is used. The special mold 101 is a mold disposed on one end portion of the plate member 421*a* in a direction perpendicular to the direction indicated by the arrow D and having a rectangular molding region with a width of 5 mm and a height of 0.5 mm in the thickness direction of the stainless steel plate in the direction perpendicular to the direction indicated by the arrow D. The leading end of the plate member 421*a* is covered with solidified polyimide elastomer having a thickness on the order of 0.2 mm as the resin portion 422*a* to form an integrally-molded component, and that component is extruded as a regulation blade member 42*a* through a discharging port.

Then, the regulation blade member 42*a* is cut into predetermined lengths by a blade cutting unit (not illustrated). At that time, when a surface of the blade member 422 that is in contact with the developing sleeve 41 in the longitudinal central portion is P, the edge of the blade cutting unit is held to the surface opposing the surface P (indicated by an arrow N in FIG. 3B), and the regulation blade member 42*a* is cut. In that way, the regulating blade 42 can have a shape that includes a protrusion 42P in which, at one end in the longitudinal direction, the end portion of the regulating blade 42 in the longitudinal direction is bent and a side that crosses the longitudinal direction of the regulating blade 42 protrudes in the thickness direction of the regulating blade 42. In the present embodiment, the regulation blade member 42*a* is cut along a direction perpendicular to the direction indicated by the arrow D such that the length of the regulation blade sheet in the direction indicated by the arrow D (longitudinal direction) is 230 mm. In that way, in the present embodiment, the regulating blade 42 includes the support member 421 with dimensions of 230 mm in length, 15 mm in width, and 0.1 mm in thickness and the blade member 422 with dimensions of 230 mm in length, 5 mm in width, and 0.5 mm in thickness.

[5. Toner Seal Member]

Figure 5A:
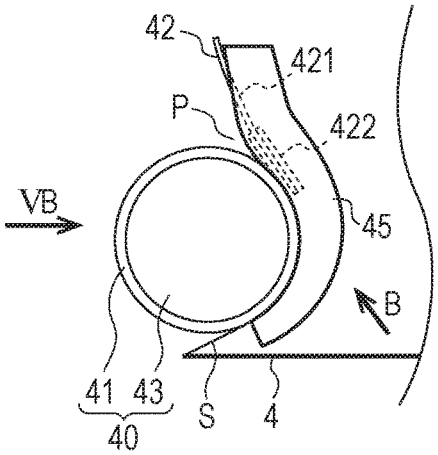
FIGS. 5A and 5B are schematic diagrams that illustrate a shape of the regulating blade according to the embodiment.
Figure 5B:
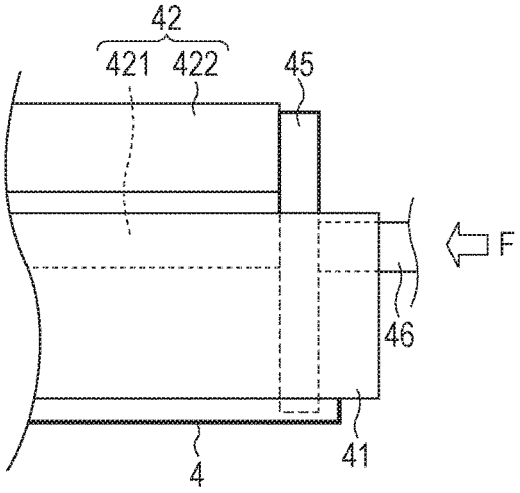

FIGS. 5A and 5B illustrate arrangement in an end portion of the developing device 4 according to the present embodiment, as seen from the axial direction of the developing sleeve. FIG. 5A illustrates arrangement in the end portion as seen from outside the developing sleeve in the axial direction. FIG. 5B illustrates arrangement in the end portion as seen from a direction of the contact portion between the developing sleeve and photosensitive drum (direction VB in FIG. 5A). FIGS. 5A and 5B illustrate arrangement of the developing sleeve 41, regulating blade 42, and a toner seal member 45 in the vicinity of the end portion of the regulating blade 42 in the longitudinal direction.

In the present embodiment, the toner seal member 45 is disposed on each of the opposite end portions of the developing sleeve 41 in the longitudinal direction such that the toner seal members 45 are in contact with the surface of the developing sleeve 41 to prevent toner from leaking from the developing chamber 4*b* in the developing device 4. Each of the toner seal members 45 is arranged so as to face an end-portion side surface of the regulating blade 42 in the longitudinal direction, another end portion side surface of the regulating blade 42 is pressed by a seal pressing member 46 to a direction F, and thus the toner seal member 45 is made to be in contact with the regulating blade 42. That is, the toner seal member 45 is disposed between the regulating blade 42 and seal pressing member 46 in the longitudinal direction and is pressed to the regulating blade 42 by the seal pressing member 46.

In the present embodiment, as illustrated in FIG. 3B, the regulating blade 42 is arranged such that the protrusion 42P on the longitudinal end portion of the blade member 422 in the longitudinal direction protrudes toward the developing sleeve 41. In that manner, the regulating blade 42 has the shape in which its longitudinal end portion more protrudes toward the developing sleeve than the longitudinal central portion, and the toner seal member 45 is pressed into contact with the regulating blade 42 by the seal pressing member 46 in the longitudinal direction.

As the toner seal member 45, a felt element that has a size in which its width extending in the longitudinal direction of the developing sleeve 41 is 4 mm and its thickness in a direction that crosses the longitudinal direction is 5 mm and that has an Asker C hardness of 45° is used. The Asker C hardness is measured by causing an indentor in an Asker durometer type C (from Kobunshi Keiki Co., Ltd.) to be in contact with the surface of the toner seal member under a condition of 100 g load. The toner seal member 45 is attached to the developing device 4 with two-sided adhesive tape.

Advantages

As described above, the regulating blade 42 includes the flexible plate-like support member 421 and the blade member 422 covering and integral with the leading end portion of the support member 421 and being in contact with the developing sleeve 41. Thus, the toner layer on the developing sleeve 41 can be made uniform.

Moreover, the regulating blade 42 can be configured such that its endurance can be improved, it can be made in contact with the developing sleeve 41 with a stable contact pressure, and changes can be easily provided from the regulating blade 42 to toner.

Figure 6A:
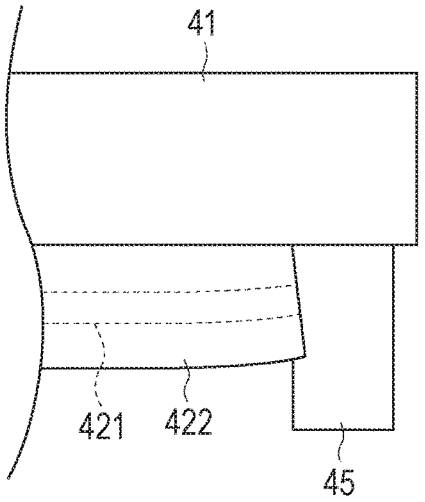
FIG. 6A illustrates a configuration of a portion in the vicinity of the toner seal member in the longitudinal end portion of the regulating blade according to the embodiment.

Additionally, in the present embodiment, the regulating blade 42 includes the blade member 422 having the shape in which the end in the longitudinal direction more protrudes in the thickness direction of the regulating blade 42 than the central portion. More specifically, the regulating blade 42 includes the protrusion 42P, in which one end portion in the longitudinal direction bends, one side that crosses the longitudinal direction of the regulating blade 42 protrudes in the thickness direction of the regulating blade 42. The protrusion 42P in the blade member 422 is arranged so as to protrude toward the developing sleeve 41, one end portion side of the regulating blade 42 is pressed by the seal pressing member 46, and thus the regulating blade 42 and toner seal member 45 are made in contact with each other. That is the toner seal member 45 is configured such that it is disposed between the regulating blade 42 and seal pressing member 46 in the longitudinal direction and is pressed to the regulating blade 42 by the seal pressing member 46. Thus, when the regulating blade 42 is in contact with the developing sleeve 41, as illustrated in FIG. 6A, the contact surface in contact with the developing sleeve is deformed by elasticity of the blade member 422, and it follows the shape of the developing sleeve. Therefore, as illustrated in FIGS. 5A and 5B, when the regulating blade 42 is in contact with the developing sleeve 41, no gap is present among the developing sleeve 41, regulating blade 42, and toner seal member 45, and toner leakage can be prevented more effectively. That configuration can make the thickness of the toner layer on the developing sleeve more uniform, in comparison with a traditional configuration in which the longitudinal end portion of the regulating blade is superimposed on the toner seal member in a direction that crosses the longitudinal direction and the regulating blade is pressed to the developing sleeve by the toner seal. Therefore, the image quality can be stabilized, and in addition, the occurrence of shaving of the developing sleeve by the regulating blade can be suppressed.

Figure 6B:
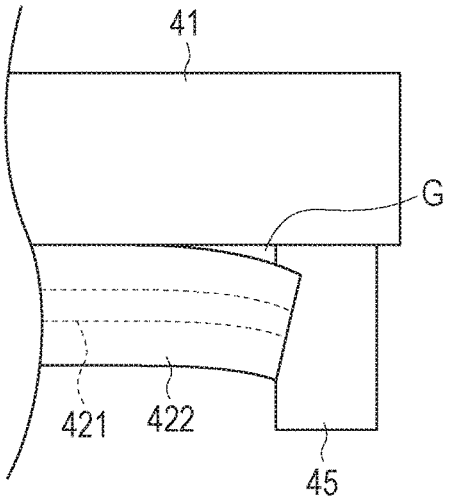
FIG. 6B illustrates that configuration according to a comparative example.

The present embodiment was compared with a comparative example (FIG. 6B). In the comparative example, the regulating blade 42 has a shape in which the longitudinal end portion protrudes from the surface P toward a side remote from the developing sleeve, and the toner seal member 45 is pressed from the side surface of the regulating blade 42 in the longitudinal direction of the regulating blade 42. In both the present embodiment and comparative example, rises in the contact pressure between the regulating blade and development roller in the vicinity of the toner seal member were suppressed, and the contact pressure of the regulating blade with respect to the development roller in the longitudinal direction was made uniform. Therefore, the image quality was stabilized, and shaving of the developing sleeve was suppressed effectively. However, in the comparative example, a gap G tended to appear among the developing sleeve 41, regulating blade 42, and toner seal member 45, and toner leaked from the developing chamber 4*b* in some cases. In contrast, in the present embodiment, the appearance of the gap among the developing sleeve 41, regulating blade 42, and toner seal member 45 was suppressed. Therefore, it is ascertained that, in the present embodiment, the image quality can be stabilized and shaving of the developing sleeve by the regulating blade can be suppressed.

To ascertain the advantages of the present embodiment, under an ordinary temperature and humidity environment of 23° C. and 50%, a text pattern of a printing ratio of 4% was printed by using the image forming apparatus in the present embodiment and that in the comparative example to check the presence or absence of image defects caused by regulation defects.

In the configuration in the comparative example, because of a gap among the developing sleeve, regulating blade, and toner seal member in the longitudinal end portion in the regulating blade, the regulating force decreased, and a regulation defect occurred. Thus, the amount of toner coating in the longitudinal end portion in the developing sleeve 41 increased, and an image defect, such as a fogging phenomenon in which toner is attached to other than an original electrostatic latent image portion or toner scattering, occurred.

In contrast, in the configuration in the present embodiment, because of no gap among the developing sleeve, regulating blade, and toner seal member in the longitudinal end portion in the regulating blade, no regulation defect occurred in the vicinity of the toner seal member 45, toner leakage was suppressed reliably, and satisfactory images were obtained.

As described above, in the present embodiment, the regulating blade in which the amount of protrusion toward the developing sleeve in its end portion is larger than that in its central portion is used. In that configuration, although the toner seal member is pressed to the longitudinal side surface of the regulating blade, a gap among the developing sleeve, regulating blade, and toner seal member can be avoided. Therefore, toner leakage caused by regulation defects was suppressed reliably, and satisfactory images with no image defects were obtained.

(Variations)

Figure 7A:
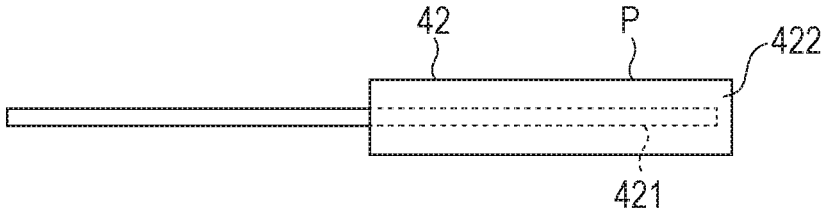
FIGS. 7A to 7C are schematic diagrams that illustrate a cross-sectional shape of the regulating blade according to variations.
Figure 7B:
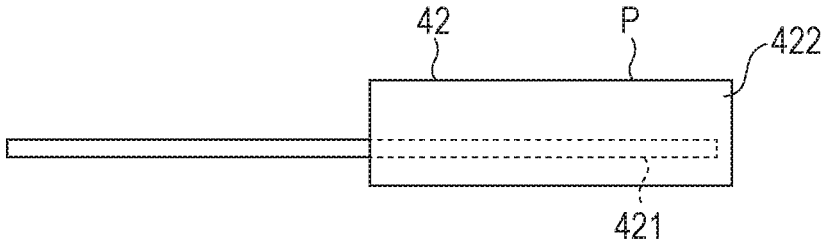
Figure 7C:
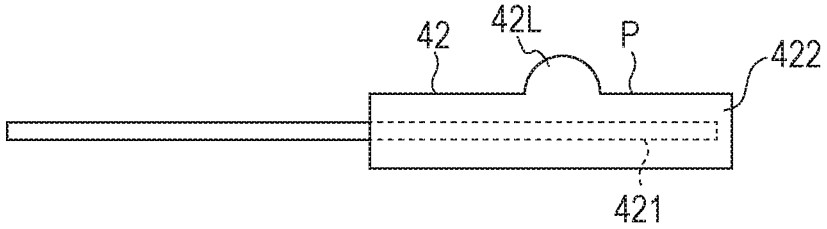

In the above-described embodiment, the regulating blade 42 includes the blade member 422 having the same thickness for both the contact surface P side in contact with the developing sleeve 41 and the non-contact surface side opposing the contact surface P with respect to the support member 421. The blade member 422 may have various shapes other than the above-described shape. In addition to the cross-sectional shape illustrated in FIG. 7A, a shape in which the contact surface P side in the blade member 422 is thicker than the non-contact surface side, as illustrated in FIG. 7B, may also be used. Moreover, as illustrated in FIG. 7C, a shape in which the regulating blade 42 includes a projection 42L extending along the longitudinal direction on the contact surface P and the blade member 422 is thick in only the contact portion on the contact surface P may also be used. With that shape in which the blade member 422 is thick on the contact surface side in contact with the developing sleeve 41, because deformation of the blade member 422 occurring when the protrusion 42P in the longitudinal end portion is in contact with the developing sleeve 41 can be smoothly accommodated, adhesiveness is improved, regulation defects are suppressed, and satisfactory images are obtainable.

With the shape in which the projection 42L extending along the longitudinal direction is included and the blade member 422 is thick in only the contact surface in contact with the developing sleeve 41, as illustrated in FIG. 7C, deformation in the shape of the end portion in the blade member 422 caused by a shearing stress in cutting for forming the regulating blade 42 can be suppressed. In addition, for the configuration in which the projection 42L extending along the longitudinal direction is included on the contact surface P in the regulating blade 42, as illustrated in FIG. 7C, toner easily moves along the protrusion on the contact surface P, and the toner easily leaks from the developing chamber 4*b*. Accordingly, the application of the present invention to the case where the projection 42L extending along the longitudinal direction is included is useful.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-177907, filed Sep. 9, 2015, which is hereby incorporated by reference herein in its entirety.

What is claimed is:

1. A developing device comprising:

a developer bearing member configured to bear a developer;

a regulating member configured to regulate an amount of the developer borne by the developer bearing member; and a toner seal member being in contact with a peripheral surface of the developer bearing member, wherein the regulating member includes a flexible support member composed by a plate-like member and a blade member covering the support member and being in contact with the developer bearing member, the regulating member is formed so that an end portion of the regulating member protrudes in a thickness direction of the regulating member in comparison with a central portion of the regulating member in a rotation axial direction of the developer bearing member, and the regulating member is disposed so that the projecting direction of the regulating member faces the developer bearing member, and the toner seal member is pressed along the rotation axial direction to the end portion of the regulating member in the rotation axial direction.

2. The developing device according to claim 1, wherein the blade member is made of resin or elastomer.

3. The developing device according to claim 1, wherein the blade member includes a protrusion extending along the rotation axial direction on a contact surface side in contact with the developer bearing member, the protrusion being a contact portion being in contact with the developer bearing member.

4. The developing device according to claim 1, wherein the developer bearing member includes an elastic layer.

5. A method for manufacturing a developing device including a developer bearing member configured to bear a developer, a regulating member configured to regulate an amount of the developer borne by the developer bearing member, and a toner seal member being in contact with a peripheral surface of the developer bearing member, the method comprising:

forming the regulating member by integrally forming a flexible plate member that is to be a support member and a resin portion, covering the flexible plate member, that is to be a blade member such that an end portion thereof more protrudes in a thickness direction of the regulating member than a central portion thereof in a rotation axial direction of the developer bearing member;

arranging the regulating member such that the end portion protrudes toward the developer bearing member; and mounting the toner seal member so that the seal member presses the end portion along the rotation axial direction.

6. The method for manufacturing the developing device according to claim 5, wherein the regulating member is manufactured by cutting a member composed of the plate member and the resin portion integral with the plate member from a surface opposing a surface that is to be in contact with the developer bearing member.

7. A process cartridge comprising:

an image bearing member;

a developer bearing member configured to bear a developer and develop the image bearing member;

a regulating member configured to regulate an amount of the developer borne by the developer bearing member; and a toner seal member being in contact with a peripheral surface of the developer bearing member, wherein the regulating member includes a flexible support member composed by a plate-like member and a blade member covering the support member and being in contact with the developer bearing member, the regulating member is formed so that an end portion of the regulating member protrudes in a thickness direction of the regulating member in comparison with a central portion of the regulating member in a rotation axial direction of the developer bearing member, and the regulating member is disposed so that the projecting direction of the regulating member faces the developer bearing member, and the toner seal member is pressed along the rotation axial direction to the end portion of the regulating member in the rotation axial direction.

8. The process cartridge according to claim 7, wherein the blade member is made of resin or elastomer.

9. The process cartridge according to claim 7, wherein the blade member includes a protrusion extending along the rotation axial direction on a contact surface side in contact with the developer bearing member, the protrusion being a contact portion being in contact with the developer bearing member.

10. The process cartridge according to claim 7, wherein the developer bearing member includes an elastic layer.

11. A method for manufacturing a process cartridge including an image bearing member, a developer bearing member configured to bear a developer and develop the image bearing member, a regulating member configured to regulate an amount of the developer borne by the developer bearing member, and a toner seal member being in contact with a peripheral surface of the developer bearing member, the method comprising:

forming the regulating member by integrally forming a flexible plate member composed by a plate-like member that is to be a support member and a resin portion covering the support member, that is to be a blade member such that an end portion thereof more protrudes in a thickness direction of the regulating member than a central portion thereof in a rotation axial direction of the developer bearing member;

arranging the regulating member such that the end portion protrudes toward the developer bearing member; and mounting the toner seal member so that the seal member presses the end portion along the rotation axial direction.

12. The method for manufacturing the process cartridge according to claim 11, wherein the regulating member is manufactured by cutting a member composed of the plate member and the resin portion integral with the plate member from a surface opposing a surface that is to be in contact with the developer bearing member.

13. The developing device according to claim 1, wherein the flexible support member is made of metal.

14. The process cartridge according to claim 7, wherein the flexible support member is made of metal.

* * * * *